United States Patent [19]

MacIntyre

[11] Patent Number: 4,880,490

[45] Date of Patent: Nov. 14, 1989

[54] ADHESIVE BACKED ELEMENT APPLICATOR

[76] Inventor: B. Stuart MacIntyre, 478 Jean St., Oakland, Calif. 94610

[21] Appl. No.: 107,669

[22] Filed: Oct. 13, 1987

[51] Int. Cl.[4] ..... B44C 1/00; B44C 7/04; B44C 7/09

[52] U.S. Cl. ..... 156/541; 156/391; 156/577; 156/579; 156/DIG. 48

[58] Field of Search ..... 156/358, 387, 391, 443, 156/480, 486, 488, 489, 490, 492, 361, 540, 541, 574, 577, 579, DIG. 37, DIG. 39, DIG. 42, 584, DIG. 24, DIG. 28, DIG. 48, 580, 582, 247, 249; 428/40, 42, 203, 918; 101/37, 39, 65

[56] References Cited

U.S. PATENT DOCUMENTS

| | | | |
|---|---|---|---|
| Re. 22,418 | 1/1944 | Salfisberg | 156/486 |
| 3,944,455 | 3/1976 | French | 156/361 |
| 4,026,758 | 5/1977 | Sato | 156/577 |
| 4,155,798 | 5/1979 | Becker | 156/461 |
| 4,366,023 | 12/1982 | Voltmer | 156/361 |
| 4,406,730 | 9/1983 | Altmix | 156/577 |
| 4,427,484 | 1/1984 | Cameron, Jr. et al. | 156/361 |
| 4,453,999 | 6/1984 | Holland-Letz | 156/361 |
| 4,466,855 | 8/1984 | Kashiwaba | 156/541 |
| 4,557,783 | 12/1985 | Grone et al. | 156/540 |
| 4,601,771 | 7/1986 | Wesley | 156/361 |
| 4,613,396 | 9/1986 | Scarborough | 156/391 |
| 4,657,622 | 4/1987 | Paules | 156/361 |

*Primary Examiner*—Michael W. Ball
*Assistant Examiner*—Louis Falasco
*Attorney, Agent, or Firm*—Glen R. Grunewald; Thomas R. Lampe

[57] ABSTRACT

A system for removing adhesive backed elements from a web and for serially applying the element including transport means for transporting the web to stripper means and actuator means engagable with a surface to actuate the transport means, applicator means to apply the stripped element to the surface, said actuator means including a member for pressing the element against a surface after it has been applied thereto.

10 Claims, 4 Drawing Sheets

ADHESIVE BACKED ELEMENT APPLICATOR

TECHNICAL FIELD

The present invention relates to a device and method for removing adhesive backed elements, such as labels, seals, and the like, from a web and for serially applying said elements.

BACKGROUND ART

It is known to array a plurality of adhesive backed elements along the length of a carrier web. The adhesive backing of the elements engages the web and the web itself is constructed of material allowing the elements to be readily removed as desired and applied to a surface. Sometimes the elements are removed by hand and applied; a time consuming and tedious process.

A number of mechanical arrangements have also been devised for stripping the elements from the carrier web and applying them where desired. Some of these devices are highly complex and expensive, particularly those adapted to operate at high speeds and automatically. Conventionally, these latter types of machines are fixed in position, with the items to which the adhesive backed elements are to be applied being fed automatically through the device from an associated storage magazine. Generally speaking, high speed, automated applicators apply the elements to items of generally uniform size, being rather limited as to the sizes and shapes of items that may be accommodated. It almost goes without saying that mechanisms of this type cannot be used to apply adhesive backed elements to surfaces not readily moveable.

Hand held devices for applying adhesive backed elements such as labels to objects have also been devised. One fairly common type of device of this nature is that which requires the application of manual force directly against the surface to which the adhesive backed element is to be applied. In other words, a portable, manually operated device of this nature generally requires that the surface to which the element is being applied be sufficiently rigid to counteract the force applied against it by the operator through the device to actually operate the device. A device of this general type is shown, for example, in U.S. Pat. No. 4,466,855. Such an arrangement is obviously inappropriate if one wishes to apply a label or other adhesive backed element to surfaces which are less than essentially rigid. Also, because the object to which the adhesive backed element is to be applied acts as a support for the device in operation, mechanisms of the opposed force type do not function well unless the surface is substantially even.

Another form of portable, manually actuatable device for applying adhesive backed elements to surfaces is that which requires the operator to manually squeeze two elements, such as two handle components together, to advance the web and strip adhesive backed elements therefrom. A representative device of this nature is that disclosed in U.S. Pat. No. 4,453,999 wherein the operator must squeeze a handle and an operating lever together to actuate a relatively complex web transport mechanism. Repeated operation will obviously be quite tiring to the operator. The device disclosed in U.S. Pat. No. 4,453,999 also requires the use of a highly specialized form of carrier tape to function.

The devices shown in U.S. Pat. Nos. 4,453,999 and 4,466,855 are also illustrative of another common failing of existing portable, manually operated adhesive backed element applicators, and that is that the web, after having the adhesive backed elements removed therefrom, exits the devices in the form of an unsightly strip which can get in the way of the applicator's operation and must be continuously disposed of by the operator. Prior art hand held labeler devices have also been generally characterized by their inability to function if the perforations formed in the carrier tape vary from the normal.

DISCLOSURE OF INVENTION

The present invention relates to a portable, manually operable device characterized by the relative simplicity of its construction, reliability of operation and ease of use by an operator. The device may be employed to apply adhesive backed elements quickly and neatly to a wide variety of objects having different physical characteristics. For example, the invention is adapted to be employed on yieldable or uneven surfaces. Engagement between the surface to which the adhesive backed element is to be applied and a portion of the device actuates the device, as is the case with prior art devices of this nature; however, the invention disclosed herein requires only light engagement pressures between the surface and the device to effect operation.

The present invention also provides an arrangement for storage of depleted adhesive backed element carrier web and means whereby the web transport system within the apparatus may be readily adapted to accommodate webs having different drive perforation characteristics.

According to the present invention, apparatus is provided for removing adhesive backed elements from a web. The apparatus includes web supply means and stripper means adapted to strip the adhesive backed elements from the web. Transport means transports the web and delivers the adhesive backed elements seriatim from the web supply to the stripper means.

Actuator means in operative association with the transport means is provided, the actuator means adapted to be placed into engagement with a surface on which an adhesive backed element is to be applied after it is stripped from the web. The actuator means actuates the transport means during the engagement and includes a member displaceable from a first position to a second position by the surface. The transport means transports the web and delivers the adhesive backed elements responsive to displacement of that member.

BRIEF DESCRIPTION OF THE DRAWINGS

Other objects and features of the present invention will become apparent from the following description taken in conjunction with the accompanying drawings wherein.

BEST MODE FOR CARRYING OUT THE INVENTION

Figure 1:
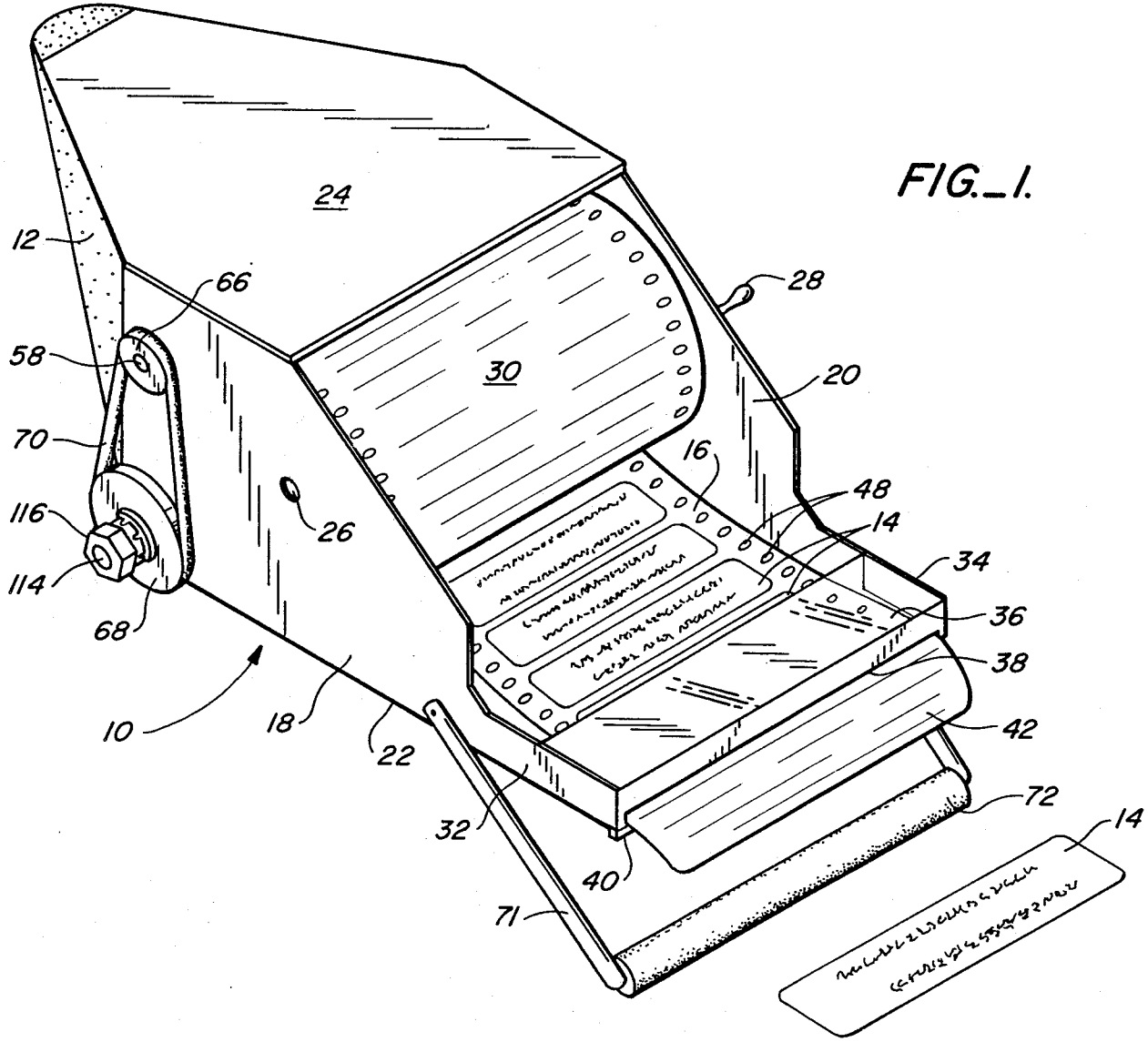
FIG. 1 is a perspective view of a preferred form of apparatus constructed in accordance with the teachings of the present invention.

Referring now to FIG. 1, apparatus constructed in accordance with the teachings of the present invention includes a housing 10 to which a manually graspable handle 12 is attached. It is the function of the apparatus to strip adhesive backed elements 14 from a carrier web 16 and apply each element 14 to a desired surface.

Housing 10 includes a pair of side walls 18, 20 interconnected by a bottom wall 22 and a top wall 24. Extending between side walls 18, 20 is a rotatable shaft 26 having a handle 28 attached thereto. To load the apparatus with the web 16 an end thereof is attached to shaft 26 in any desired fashion and handle 28 rotated to wind the web onto the shaft to form a web supply roll 30. Thus, the shaft 26 functions as a web supply means.

Figure 4:
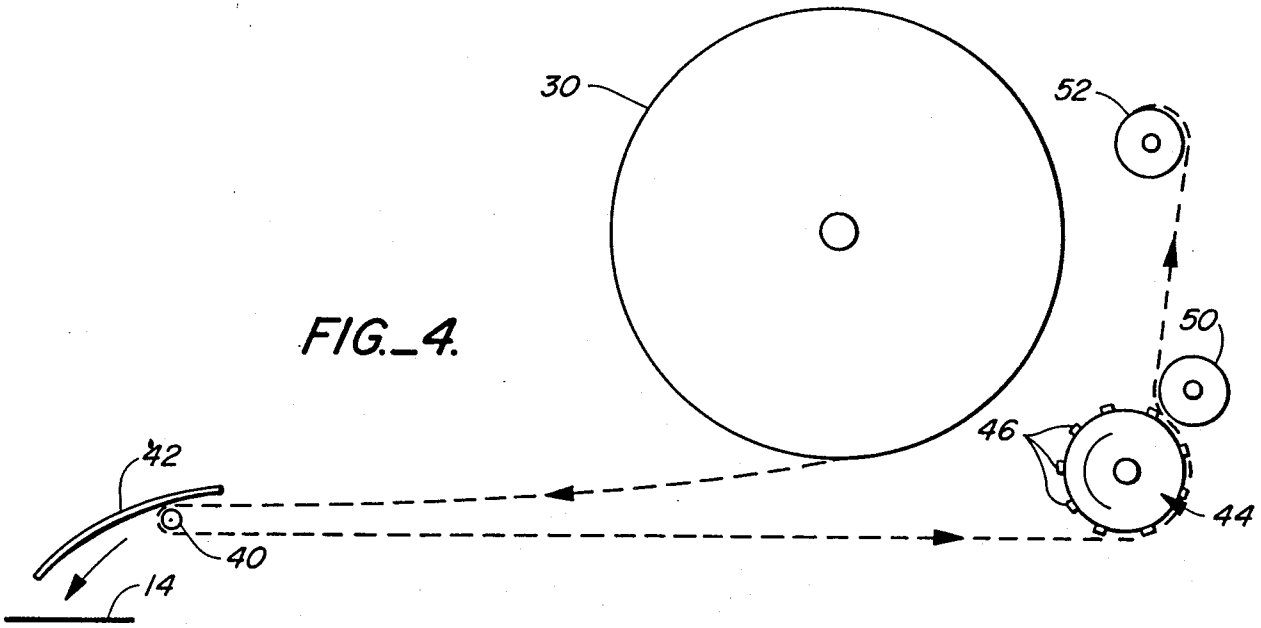
FIG. 4 is a schematic presentation showing selected components of the apparatus and the path of the carrier web.

Side walls 18, 20 narrow as shown to form extensions 32, 34. Extending between said extensions is a plate 36 defining a slit 38 with bottom wall 22. Web 16 is adapted to pass through said slit and around a rotatable bar 40 mounted on extensions 32, 34 and extending across the full length of the slit. A curved tongue member 42 is fixedly mounted on plate 36 above the slit. As will be described in greater detail below, the tongue member functions as an applicator means for bringing a stripped adhesive backed element 14 into contact with a desired surface. FIG. 4 provides a schematic representation of this applicator action and illustrates the path of movement of web 16 through the device, as indicated by the arrows.

After the operator threads the web 16 about bar 40 the web is fed along the bottom of bottom wall 22 and then looped about a rotatable drive shaft 44 comprising a portion of the web transport means of the apparatus. Drive shaft 44 has a plurality of spaced projections 46 disposed about the periphery thereof and at both ends of the shaft. It will be appreciated that projections 4 enter into the perforations 48 formed along the edges of web 16 (FIG. 1). From drive shaft 44 the web is looped around idler roll 50 and the leading end of the web is brought into engagement with and secured to a rotatable take-up spindle 52.

Figure 3:
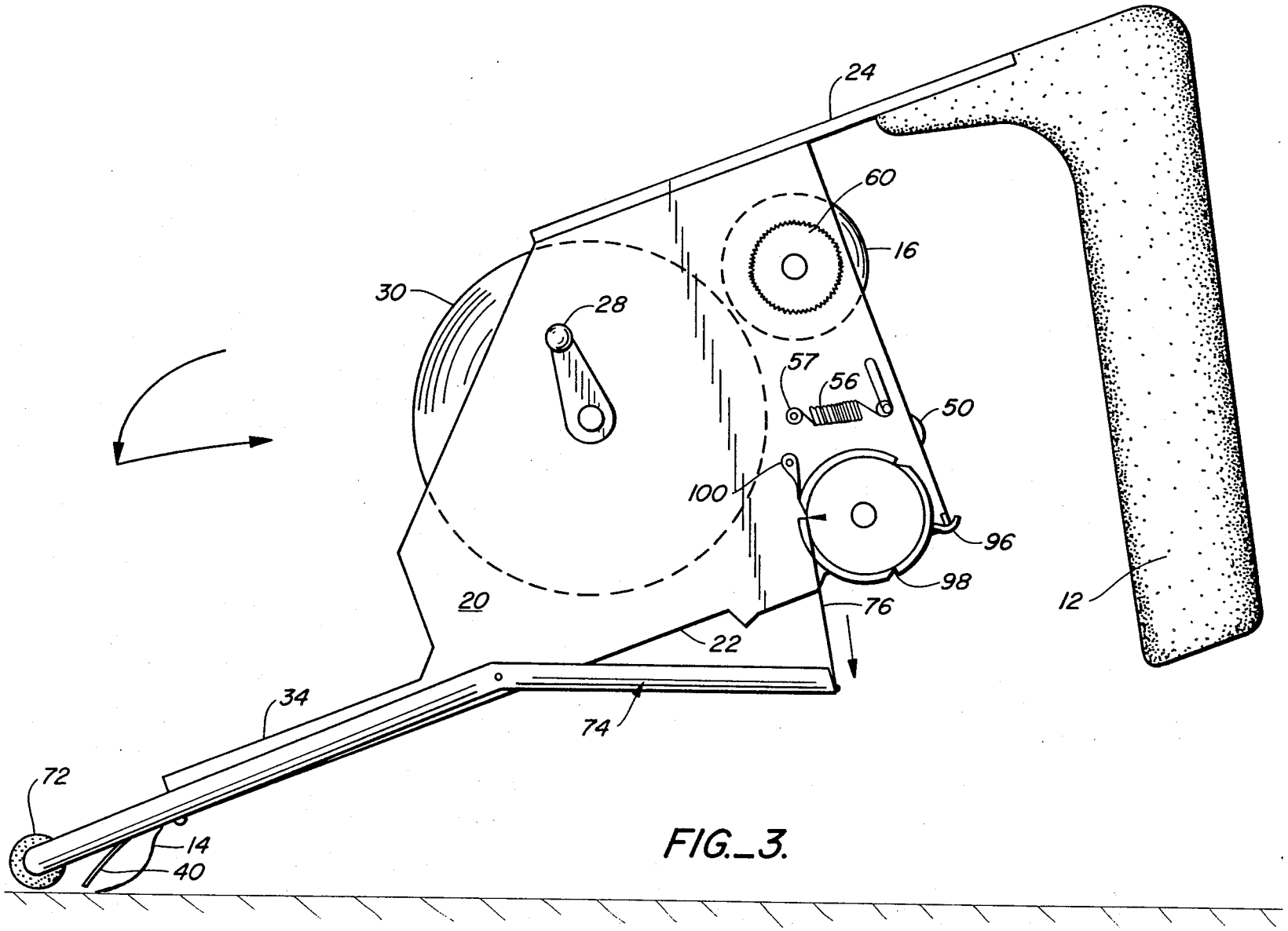
FIG. 3 is a view similar to that of FIG. 2 but showing an adhesive backed element being applied to a surface.

Idler roll 50 is rotatably mounted on a generally U-shaped support member 54 extending between side walls 20, 22. As shown in FIG. 3, a portion of support member 54 extends through side wall 20 and projects downwardly and outwardly to accommodate an end of a coil, tension spring 56. The other end of spring 56 is attached to a projection 57 secured to wall 20. Thus, spring 56 operates to continuously urge support member 54 in a clockwise direction (as viewed in FIG. 3) and maintain idler roll 50 in engagement with the web 16 as it passes between drive shaft 44 and take-up spindle 52.

Figures 2, 7:
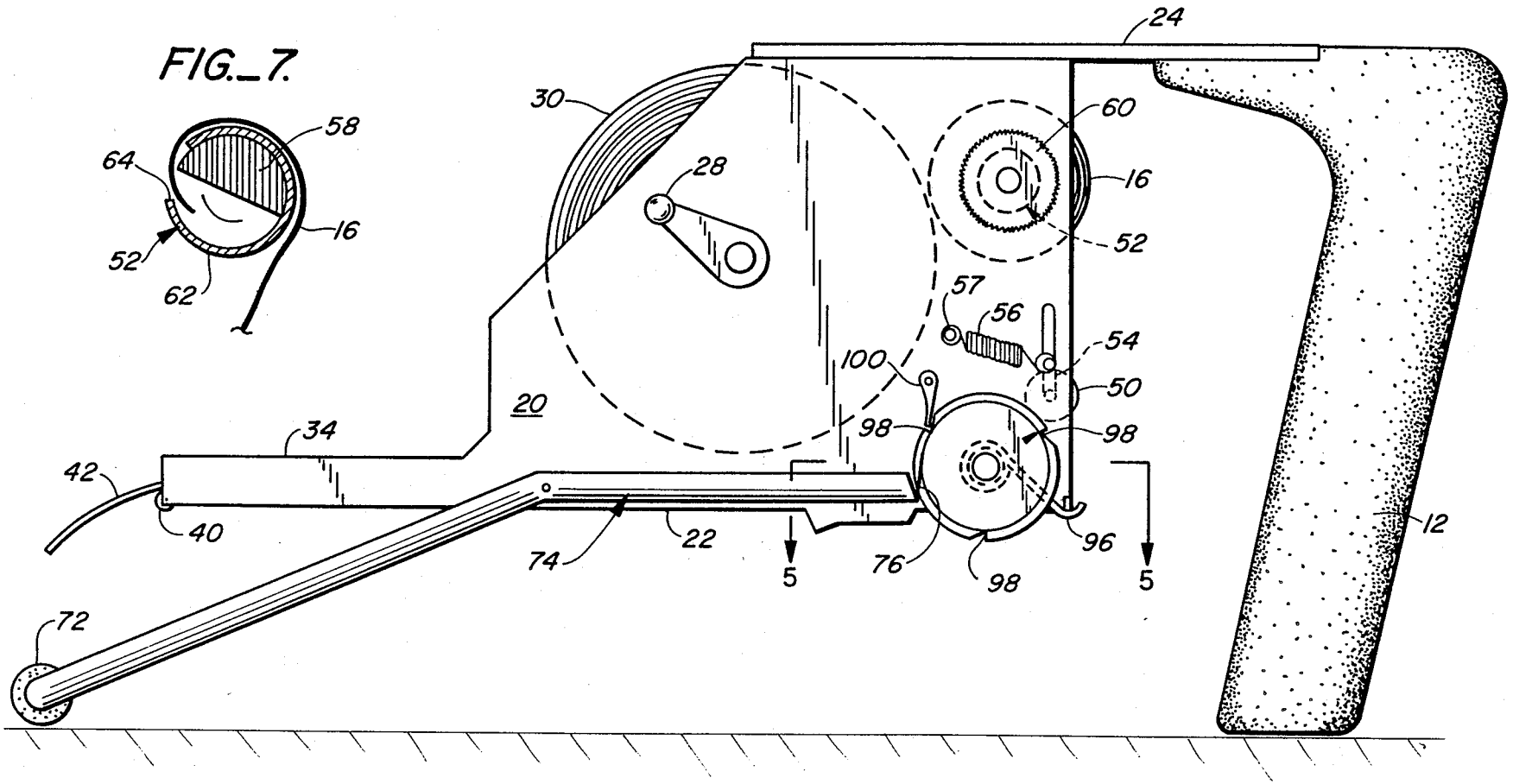
FIG. 2 is a side elevation illustrating the relative positions assumed by the components of the apparatus prior to applying an adhesive backed element to a surface.
FIG. 7 is an enlarged, cross-sectional view illustrating operational details of a rotatable take-up spindle for receiving the carrier web.

Take-up spindle 52 is of a multi component nature and provides a means for clamping the leading end of web 16. FIGS. 3 and 7 illustrate this feature. Essentially, the clamping means comprises a take-up shaft 58 connected directly to a knob 60 projecting externally of the housing. The take-up shaft 58 has a cross-section in the shape of a semi-circle. Disposed about take-up shaft 58 and movable with respect thereto is a cylinder 62 having an opening 64 along the length thereof. To secure the web 16 to the take-up spindle 52 the leading end thereof is positioned in opening 64 as shown in FIG. 7. The leading end is then clamped into place by rotating take-up shaft 58 in the direction of the arrow in FIG. 7 so that the web is frictionally engaged between take-up shaft 58 and cylinder 62. Rotation of drive shaft 44 will cause a rotation of take-up spindle 52. As shown in FIG. 1, take-up shaft 58 is frictionally attached to a first sheave 66 and adapted to rotate therewith. First sheave 66 is disposed above second sheave 68 connected to and rotatable with drive shaft 44. Sheaves 66, 68 are interconnected by a belt 70.

Pivotally attached to the bottom of housing 10 is actuator means in the form of bail 71. Bail 71 has rotatably mounted thereon a roller 72. One leg of bail 71, leg 74, extends beyond its point of attachment to housing 10. With particular reference to FIGS. 2 and 3, it may be seen that bail leg 74 is connected to a band 76 of steel or other suitable material which is normally partially wrapped about a drive collar 90 at an end of drive shaft 44.

Figure 5:
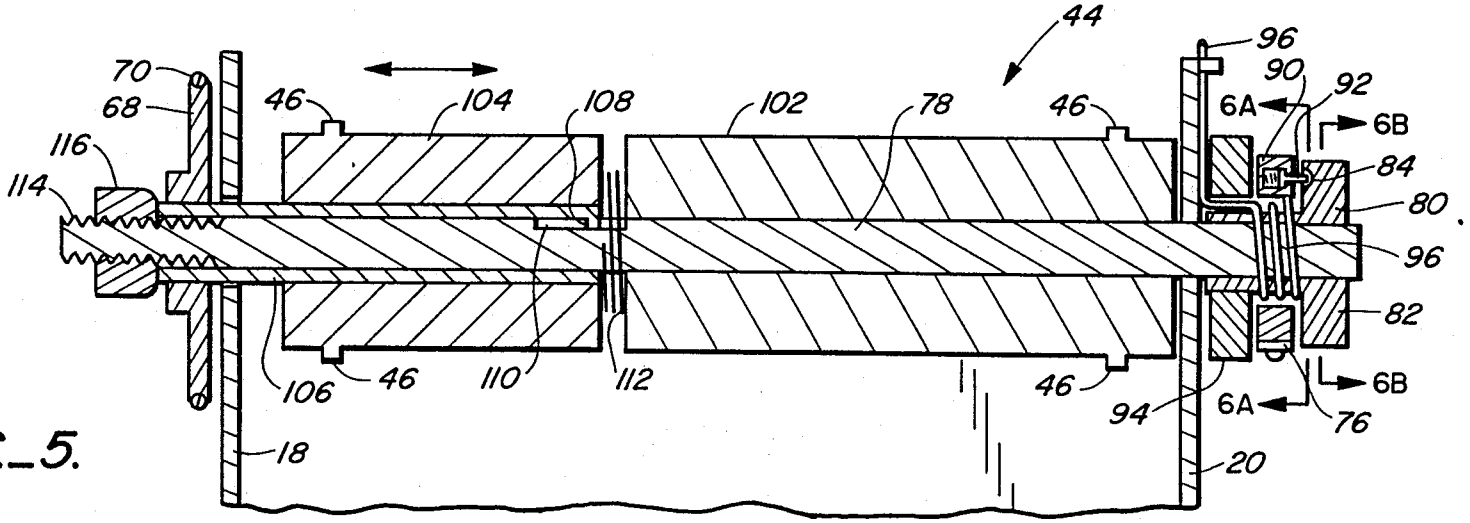
FIG. 5 is a enlarged cross-sectional view taken along the line 5—5 in FIG. 2.

FIG. 5 should now be referred to for specific structural details of drive shaft 44. Drive shaft 44 includes a cylindrical bar 78 having ends projecting beyond side walls 18, 20. A sleeve 80 is positioned over the end of bar 78 projecting beyond side wall 20, said sleeve including a flange 82 having three recesses 84 formed therein, the recesses 84 being positioned equidistant, or at 120 degree intervals, about flange 82. Each recess 84 includes a ramp-like surface 86 extending inwardly into the flange 82 and terminating at a flat wall 88 in the flange.

Positioned adjacent to flange 82 and rotatable about the reduced portion of sleeve 80 is drive collar 90 having a spring-loaded pin 92 mounted therein, said pin being continuously biased toward flange 82. Band 76 is secured to collar 90 by any suitable expedient such as a screw.

Clockwise rotation of bail 71 from a first position illustrated in FIG. 2 to a second position illustrated in FIG. 3 will exert tension on band 76 and cause counterclockwise rotation of collar 90 as viewed in those Figures.

Fixedly mounted to sleeve 80 at the end thereof remote from flange 82 is a radially projecting member 94 which prevents movement of collar 90 away from flange 92.

A coil spring 96 is disposed between collar 90 and bar 78. On end of spring 96 is secured to collar 90 and the other end to housing 10 (see FIG. 2). The spring 90 yieldably resists counterclockwise movement of the collar as viewed in FIGS. 2 and 3.

Unwinding of band 76 due to movement of the bail 71 from the first position shown in FIG. 2 to the second position shown in FIG. 3 will cause the pin 92 to engage the flat face or wall 88 of one of the recesses 84 and thus cause rotation of sleeve 80 and cylindrical bar 78. This common rotation will continue until band 76 is unwound from collar 90.

The band 76 is of course unwound because of the force exerted against roller 72 of the bail by the surface it engages. When the roller is lifted away from the surface, spring 96 will cause clockwise rotation of collar 90 and a rewinding of the band onto the collar. However, clockwise movement of cylindrical bar 78 will be prevented by virtue of the fact that notches 98 are formed about the periphery of member 94 and one of said notches is engaged by a pawl 100 mounted on side wall 20. The ramp-like surfaces on recesses 84 enable pin 92 to move over any recess 84 it engages and thus collar 90 will return to its initial position under the urging of spring 96.

The web engaging portions of drive shaft 44 are identified by reference numerals 102 and 104. Portion 102 is fixedly secured to cylindrical bar 78. Portion 104, however, is fixedly secured to an adjustment sleeve 106 including a projection 108 longitudinally slidable in a elongated channel 110 formed in cylindrical bar 78. A spring 112 urges portions 102, 104 apart.

Screw threads 114 are formed on cylindrical bar 78 with a nut 116 threadably engagable therewith. By screwing and unscrewing nut 116 web engaging portion 104 may be moved toward or away from web engaging portion 102. Thus, the distances between the projections 46 on web engaging portion 102 may be varied with respect to the projections 46 on web engaging portion 104 so the drive shaft 44 may accommodate webs having different distances between lines of perforations along the edges thereof.

The operation of the device is as follows. After the web supply roll 30 has been formed, the web threaded through the device as previously described and engaged in take-up spindle 52, the device is ready for use.

The operator brings the actuator means in the form of bail 71 and roller 72 into engagement with a surface on which an adhesive backed element is to be applied. Roller 72 and the bail are displaced from the first position illustrated in FIG. 2 to the second position illustrated in FIG. 3 by the operator exerting a downward force on the surface by the roller. This force can be very slight because of the mechanical advantage provided by the bail which of course operates as a lever.

As roller 72 is displaced, band 76 functions as a means for transmitting the movement of the bail into rotational movement of collar 90 and thus web engaging portions 102, 104. The take-up spindle 52 also rotates due to the action of belt 70. Because projections 46 are disposed through perforations 48 of the web, the web will be advanced and when the web passes about rotatable bar 40 an adhesive backed element 14 will be stripped therefrom.

Tongue member or applicator plate 42 directs the stripped adhesive backed element downwardly and into contact with the surface whereby the element is applied thereto. The operator then pulls the device toward himself and away from the applied adhesive backed element whereby applicator plate 42 is withdrawn therefrom. Continued pulling of the device toward the operator will bring roller 72 into engagement with the applied adhesive backed element to press the element against the surface.

Figure 6A:
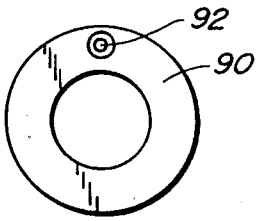
FIGS. 6A and 6B are views taken along the lines 6A—6A and 6B—6B in FIG. 5, respectively, and showing details of components utilized in the web transport system.
Figure 6B:
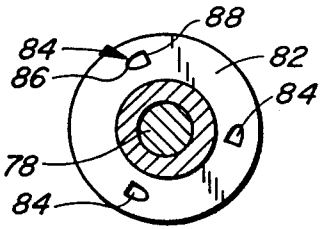

To apply another adhesive backed element the operator simply lifts the device away from the surface so that the parts thereof reassume the positions illustrated in FIG. 2. The aforedescribed mechanism illustrated in FIGS. 5, 6A and 6B operates to drive the web in increments corresponding to the spacing between the adhesive backed elements thereof. Incremental movement will obviously be determined by the number and location of recesses 84 and the length of band 76.

What is claimed is:

1. Apparatus movable relative to an object and engageable with the surface of said object, said apparatus adapted to serially remove adhesive backed elements from a web and apply an element to said surface responsive to said engagement, said apparatus comprising, in combination:

web supply means;

stripper means adapted to strip said adhesive backed elements from said web;

transport means for transporting said web and delivering said adhesive backed elements seriatim from said web supply means to said stripper means, said transport means including a rotatable drive shaft engageable with said web, said drive shaft including spaced projections disposed about the periphery thereof, said projections adapted to be positioned in perforations formed in said web, and a rotatable take-up spindle for receiving said web after engagement of said web by said drive shaft and for winding up said received web;

actuator means in operative association with said transport means and including a member displaceable from a first position to a second position by said object surface during engagement between said apparatus and surface and during movement of said apparatus relative to said object; and transmission means interconnecting said actuator means and said transport means, said transmission means being responsive to movement of said actuator means member from said first position to said second position to cause said transport means to transport said web and deliver an adhesive backed element to said stripper means whereby said stripped element may be applied to said surface by said apparatus during continued movement of said apparatus relative to said object, said actuator means member being adapted to be brought into engagement with an adhesive backed element applied to said surface to press said adhesive backed element against said surface during continued movement of said apparatus relative to said object, said transmission means interconnecting said actuator means member, said drive shaft and said take-up spindle, said transmission means being responsive to displacement of said actuator means member from said first position to said second position to rotate both said drive shaft and said take-up spindle.

2. The apparatus of claim 1 wherein said actuator means member comprises a roller adapted to roll over said surface during displacement of said member.

3. The apparatus of claim 1 additionally comprising applicator means for bringing a stripped adhesive backed element into contact with said surface prior to engagement of said adhesive backed element by said actuator means member.

4. The apparatus of claim 3 wherein said applicator means comprises an applicator plate disposed adjacent to said stripper means, said applicator plate adapted to be withdrawn away from said adhesive backed element after bringing said adhesive backed element into contact with said surface, said actuator means member disposed adjacent to and movable with said applicator plate.

5. The apparatus of claim 1 additionally comprising biasing means for continuously urging said actuator means member toward said first position.

6. The apparatus of claim 1 further comprising adjustment means for adjusting the positions of said projections relative to said drive shaft whereby webs having different perforation patterns may be accommodated.

7. The apparatus of claim 1 wherein said take-up spindle includes clamping means for clamping the leading end of said web.

8. Apparatus adapted to be moved and placed into engagement with the surface of an object and for applying an adhesive backed element to said object, said apparatus comprising, in combination:

web supply means for supplying a web having a plurality of adhesive backed elements thereon;

stripper means adapted to strip adhesive backed elements from said web;

applicator means for bringing a stripped adhesive backed element into contact with said surface;

actuator means engageable with said surface substantially simultaneously with said applicator means bringing said stripped adhesive backed element into contact with said surface, said applicator means including a member displaceable from a first position to a second position by said surface during engagement between said apparatus and surface and during movement of said apparatus relative to said object;

transport means responsive to movement of said actuator means after engagement between said actuator means and said surface to transport said web from said web supply means toward said stripper means; and transmission means interconnecting said actuator means and said transport means, said transmission means being responsive to movement of said actuator means member from said first position to said second position to cause said transport means to transport said web and deliver and adhesive backed element to said stripper means whereby said stripped element may be applied to said surface by said apparatus, said actuator means member being adapted to engage an adhesive backed element brought into contact with said surface by said applicator means to press said adhesive backed element against said surface, said actuator means comprising a bail and said actuator means member comprising a roller rotatably mounted on said bail.

9. The apparatus of claim 8 additionally comprising biasing means continuously urging said actuator means member toward said first position.

10. The apparatus of claim 8 wherein said stripper means includes a roller about which said web passes at the location where the adhesive backed element is stripped therefrom.

* * * * *